US006323720B1

(12) United States Patent
Kim et al.

(10) Patent No.: US 6,323,720 B1
(45) Date of Patent: Nov. 27, 2001

(54) INTERNAL VOLTAGE GENERATOR USING ANTI-FUSE

(75) Inventors: Young-Hee Kim, Pahang-shi; Kie Bong Ku, Yicheon-shi, both of (KR)

(73) Assignee: Hyundai Electronics Industries Co., Ltd., Yicheon-shi (KR)

( * ) Notice: Subject to any disclaimer, the term of this patent is extended or adjusted under 35 U.S.C. 154(b) by 0 days.

(21) Appl. No.: 09/342,218

(22) Filed: Jun. 29, 1999

(30) Foreign Application Priority Data

Jun. 30, 1998 (KR) ..... 98 26224

(51) Int. Cl.[7] ..... G05F 1/10
(52) U.S. Cl. ..... 327/525; 327/541
(58) Field of Search ..... 327/525, 526, 327/540, 538, 541, 543; 323/313

(56) References Cited

U.S. PATENT DOCUMENTS 5,434,498 * 7/1995 Cordoba et al. ..... 323/313
5,583,463 * 12/1996 Merrit ..... 327/526
5,600,277 * 2/1997 Koelling ..... 327/525
5,731,733 * 3/1998 Deham ..... 327/525
5,825,697 10/1998 Gilliam et al. ..... 365/200
5,852,379 * 12/1998 Jiang ..... 327/525
5,959,445 * 9/1999 Denham ..... 327/525
5,982,163 * 11/1999 Shinozaki ..... 323/313

* cited by examiner

*Primary Examiner*—Terry D. Cunningham
(74) *Attorney, Agent, or Firm*—Oliff & Berridge, PLC

(57) ABSTRACT

The present invention relates to an internal voltage generator using anti-fuse, which generates decoding signals using anti-fuses capable of being programmed by signals inputted from the outside, and then generates the internal voltages, each of them having a different level, thereby conveniently trimming the internal voltage to be suitable for an external environment even at a packaging step process of a semiconductor device. Decoding means for generating the decoding signals includes: buffer means changing voltage signals of TTL level inputted through bonding pads to those of CMOS level; programming signal generation means generating signals for programming the anti-fuses in accordance with signals from said buffer means; a plurality of anti-fuse means having the anti-fuses capable of being programmed by the signals from said programming signal generation means, and outputting signals in response to a state of the anti-fuses; and output means performing a logical operation of the signals from said anti-fuse means, thereby outputting said decoding signals.

22 Claims, 6 Drawing Sheets

| PAD1 | PAD2 | PAD3 | PGM | PBMB | REP1 | REPB1 | REP2 | REPB2 | REP3 | REPB3 | DECODING SIGNALS BEING ACTIVE |
|---|---|---|---|---|---|---|---|---|---|---|---|
| 0 | 0 | 0 | 0 | 1 | 0 | 1 | 0 | 1 | 0 | 1 | S7 |
| 0 | 0 | 1 | 1 | 0 | 0 | 1 | 0 | 1 | 1 | 0 | S6 |
| 0 | 1 | 0 | 1 | 0 | 0 | 1 | 1 | 0 | 0 | 1 | S5 |
| 0 | 1 | 1 | 1 | 0 | 0 | 1 | 1 | 0 | 1 | 0 | S4 |
| 1 | 0 | 0 | 1 | 0 | 1 | 0 | 0 | 1 | 0 | 1 | S3 |
| 1 | 0 | 1 | 1 | 0 | 1 | 0 | 0 | 1 | 1 | 0 | S2 |
| 1 | 1 | 0 | 1 | 0 | 1 | 0 | 1 | 0 | 0 | 1 | S1 |
| 1 | 1 | 1 | 1 | 0 | 1 | 0 | 1 | 0 | 1 | 0 | S0 |

FIG.6

INTERNAL VOLTAGE GENERATOR USING ANTI-FUSE

BACKGROUND OF THE INVENTION

1. Field of the Invention

The present invention relates to an internal voltage generator for a semiconductor device, and more particularly to an internal voltage generator using anti-fuse which is capable of conveniently trimming the internal voltage to be suitable for an external environment even at the packaging step for fabricating the semiconductor device.

2. Description of the Prior Art

An internal voltage generator is widely used in order to drive a semiconductor device in a chip with a relatively low voltage. The internal voltage generator receives an external voltage of a high level so as to generate new internal voltages in the chip. Using the internal voltages, the chip can reduce power consumption therein, and operate more rapidly.

The internal voltage should have a predetermined lever regardless of variations in the external voltage, a temperature around the chip, and a process.

FIG. 1 is a block diagram showing a conventional internal voltage generator.

As shown in this drawing, the conventional internal voltage generator comprises a first voltage generator 1 for producing a voltage Vr1 which has a constant level irrespective of variations in the temperature or the external voltage, a decoding unit 2 for generating signals s0 to s7 according to a selective blowing of fuses therein, and a second voltage generator 3 for amplifying the voltage Vr1 from the first voltage generator 1 in response to the signals s0 to s7 from the decoding unit 2, thereby generating a amplified voltage Vr2.

The conventional internal voltage generator further comprises a third voltage generator 4 for making an internal voltage Vr according to the output voltage Vr2 of the second voltage generator 3, and a fourth voltage generator 5 for producing an activation voltage Vact in the case that the DRAM becomes active.

The conventional internal voltage generator further comprises a first voltage drive unit 6 for controlling an internal voltage Vint in a standby state of the DRAM according to the voltages Vr1 and V1, which are applied by the first and the third voltage generators 1 and 4, respectively.

In addition, the conventional internal voltage generator comprises a second voltage drive unit 7 for controlling the internal voltage Vint when the DRAM operates on the basis of the voltages Vr1, Vr and Vact, which are applied by the first, third and fourth voltage generators 1, 4 and 5, respectively.

Typically, the first voltage generator 1 is provided with a Widlar reference voltage generator.

As shown in FIG. 2, the decoding unit 2 includes fuse units F1, F2 and F3 for receiving an external voltage Vext through their input terminals to respectively generate signals rep1 and repb1, rep2 and repb2, and rep3 and repb3. The decoding unit 2 further includes an output unit DOUT1 for logically combining the signals rep1 to rep3 and, repb1 to repb3 in order to make the signals s0 to s7 prior to supplying the second voltage generator 3 with the signals s0 to s7.

The output unit DOUT1 includes NAND gates NAND1 to NAND8 for being enabled by the external voltage Vext and outputting the signals of a low level in the case that all of three signals among the signals rep1 to rep3 and repb1 to rep3 have a high level. The output unit DOUT1 further includes inverters IN1 to IN8 for being enabled thereby, and inverting the signals from the NAND gates NAND1 to NAND8 prior to supplying the second voltage generator 3 with the signals s0 to s7.

As shown in FIG. 3, the fuse unit F1 in the decoding unit 2 includes a charging unit 8 for being charged by the external voltage Vext applied via a fuse PF, and an output unit Fout for buffering the voltage charged in the charging unit 8 after being enabled thereby and then applying the signals rep1 and repb1 to the output unit DOUT1. The fuse unit F1 further comprises a discharging unit 9 for being driven by the signal from the output unit FOUT, thereby completely discharging the voltage of the charging unit 8 when the fuse PF is blown.

The charging unit 8 and the discharging unit 9 are made of a decoupling capacitor N8 and a N-channel MOS transistor N9, respectively.

The output unit FOUT includes inverters IN9 , IN10 and IN11 for being enabled thereby and sequentially coupled to the charging unit 8, the discharging unit 9 and the fuse PF in common, wherein the output terminal of the inverter IN9 is also coupled to the gate of the N-channel MOS transistor N9 included in the discharging unit 9, and the inverters IN10 and IN11 generate the signals repb1 and rep1, respectively.

The fuse units F2 and F3 included in the decoding unit 2 are the same as the above mentioned fuse unit F1 in their constructions.

Hereinafter, the operation of the conventional internal voltage generator will be described in detail referring to the attached drawings.

As shown in FIG. 1, the second voltage generator 2 amplifies the voltage Vr1, which is applied by the first voltage generator 1 on the basis of the signals s0 to s7 from the decoding unit 2. In this case, the decoding unit 2 logically combines the signals rep1 to rep3 and repb1 to repb3 and then generates the signals s0 to s7, as shown in FIG. 2.

Namely, with reference to FIG. 3, the output signal of the inverter IN9 is applied to the gate of the N-channel MOS transistor N9 included in the charging unit 9. Therefore, the N-channel MOS transistor N9 is turned on in response to the high level signal from the inverter IN9 when the fuse PF is blown, thereby causing the voltage charged in the decoupling capacitor N8 to be discharged rapidly. At this time, the signal rep1 is pulled up to the high level, whereas the signal repb1 is pulled down to the low level.

In this manner, if at least one of the fuses is selectively blown in accordance with the operation state of the DRAM, the decoding unit 2 supplies the second voltage generator 3 with the signals s0 to s7 after logically combining the signals rep1 to rep3 and repb1 to repb3. The second voltage generator 3 amplifies the input voltage Vr1 to be the voltage Vr2 having a desired level, such that the internal voltage Vint is consequently generated.

The fuses included in the fuse units F1, F2 and F3 are made of poly-silicon and can be blown by a laser beam.

In the case of cutting polysilicon using a laser beam, this laser cutting method suffers from disadvantages such that an error may occur in accurately applying the laser beam to the polysilicon and a residue may remain around the disconnection part after the cutting. Another disadvantage of the laser cutting method is in that a large amount of processing time is required, and it is difficult and inaccurate to perform the method. Further, the laser cutting method has another disadvantage such that it is impossible to trim the level of the internal voltage at a packaging process of the semiconductor device, resulting in a degradation in reliability of the semiconductor device.

SUMMARY OF THE INVENTION

Therefore, it is an object of the present invention to provide an internal voltage generator using anti-fuse for being capable of conveniently trimming the internal voltage to be suitable for an external environment even at a packaging step of fabricating the semiconductor device.

It is another object of the present invention to provide an internal voltage generator using anti-fuse for rapidly blocking a current path established through the anti-fuse after the anti-fuse is programmed, thereby reducing a current amount consumed when the anti-fuse is programmed.

To accomplish the above mentioned object, the present invention provides an internal voltage generator using anti-fuses which trims an inputted voltage on the basis of decoding signals from a decoding unit and then generates internal voltages having a level different from each other, comprising: buffer means changing voltage signals of TTL level inputted through bonding pads to those of CMOS level; programming signal generation means generating signals for programming the anti-fuses in accordance with signals from said buffer means; a plurality of anti-fuse means having the anti-fuses capable of being programmed by the signals from said programming signal generation means, and outputting signals in response to a state of the anti-fuses; and output means performing a logical operation of the signals from said anti-fuse means, thereby outputting said decoding signals.

BRIEF DESCRIPTION OF THE DRAWINGS

The above and other objects and aspects of the invention will become apparent from the following description of embodiments with reference to the accompanying drawings in which:

FIG. 6 is a table illustrating decoding signals which are active in response to signals inputted to anti-fuse units as shown in FIG. 4.

DETAILED DESCRIPTION OF THE PREFERRED EMBODIMENTS

Hereinafter, the preferred embodiments of the present invention will be described with reference to the accompanying drawings.

Figure 4:
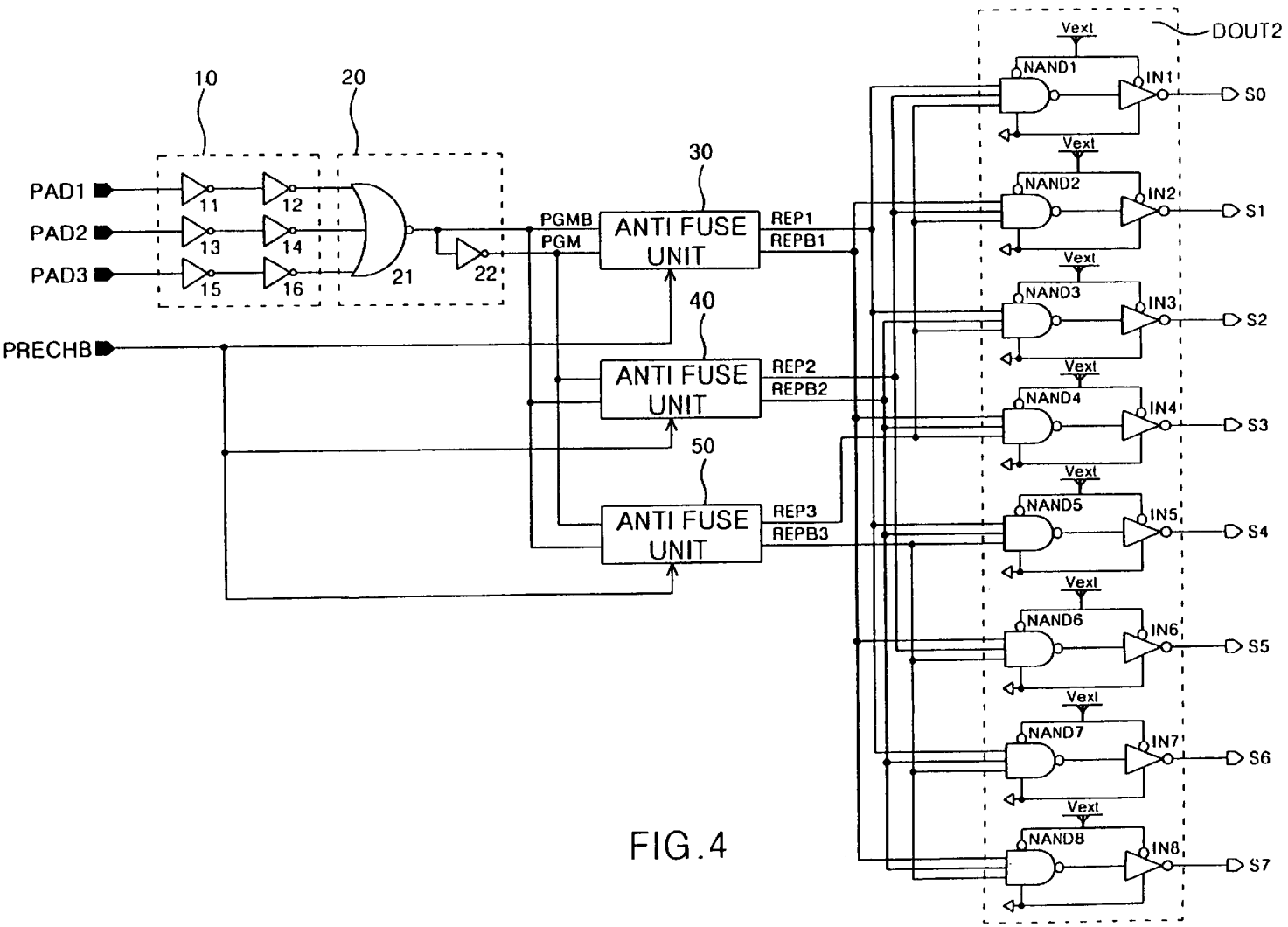
FIG. 4 is a detailed circuit diagram of a decoding means included in an internal voltage generator using anti-fuses in accordance with the present invention.

The present invention includes a decoding means for trimming the level of the internal voltage. The decoding means comprises a circuit which includes anti-fuses capable of being programmed in response to voltage signals inputted through bonding pads, and generates decoding signals according to the state of the anti-fuses. The decoding means is illustrated in FIG. 4.

With reference to this drawing, the decoding means comprises a buffer 10 for changing voltage signals of TTL level inputted through bonding pads PAD1 to PAD 3 to those of CMOS level, and a programming signal generation unit 20 for generating signals PGM and PGMB in order to program the anti-fuses in accordance with signals from the buffer 10.

The decoding means further comprises a plurality of anti fuse units 30, 40 and 50, each of which includes the anti-fuse capable of being programmed by the signals PGM and PGMB outputted from the programming signal generation unit 20, and outputs a pair signals REP1 and REPB1, REP2 and REPB2, and REP2 and REPB3, respectively, in response to a state of the anti-fuse.

Figure 1:
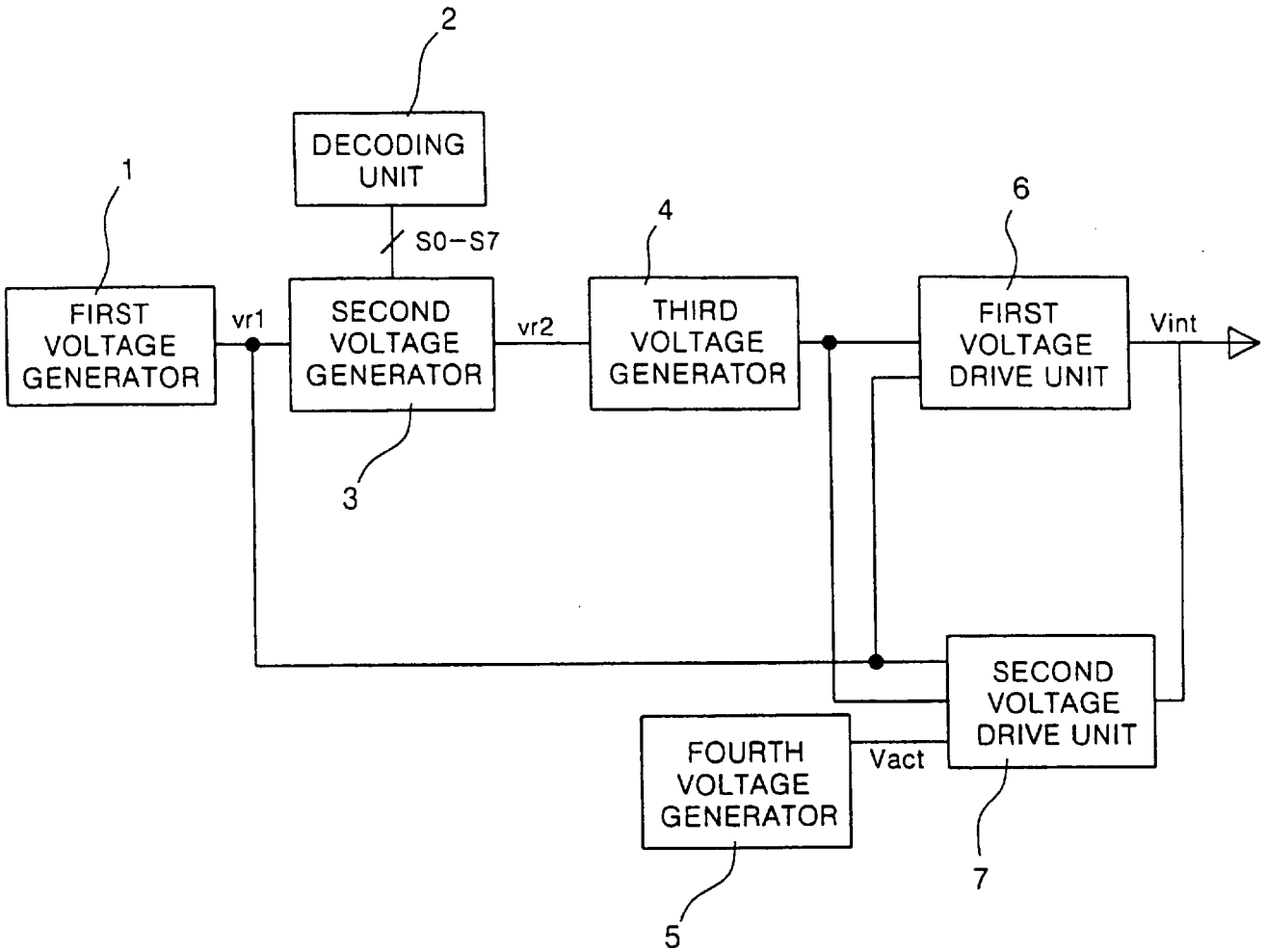
FIG. 1 CONVENTIONAL ART
FIG. 1 is a block diagram of a conventional, Internal voltage generator.
Figure 2:
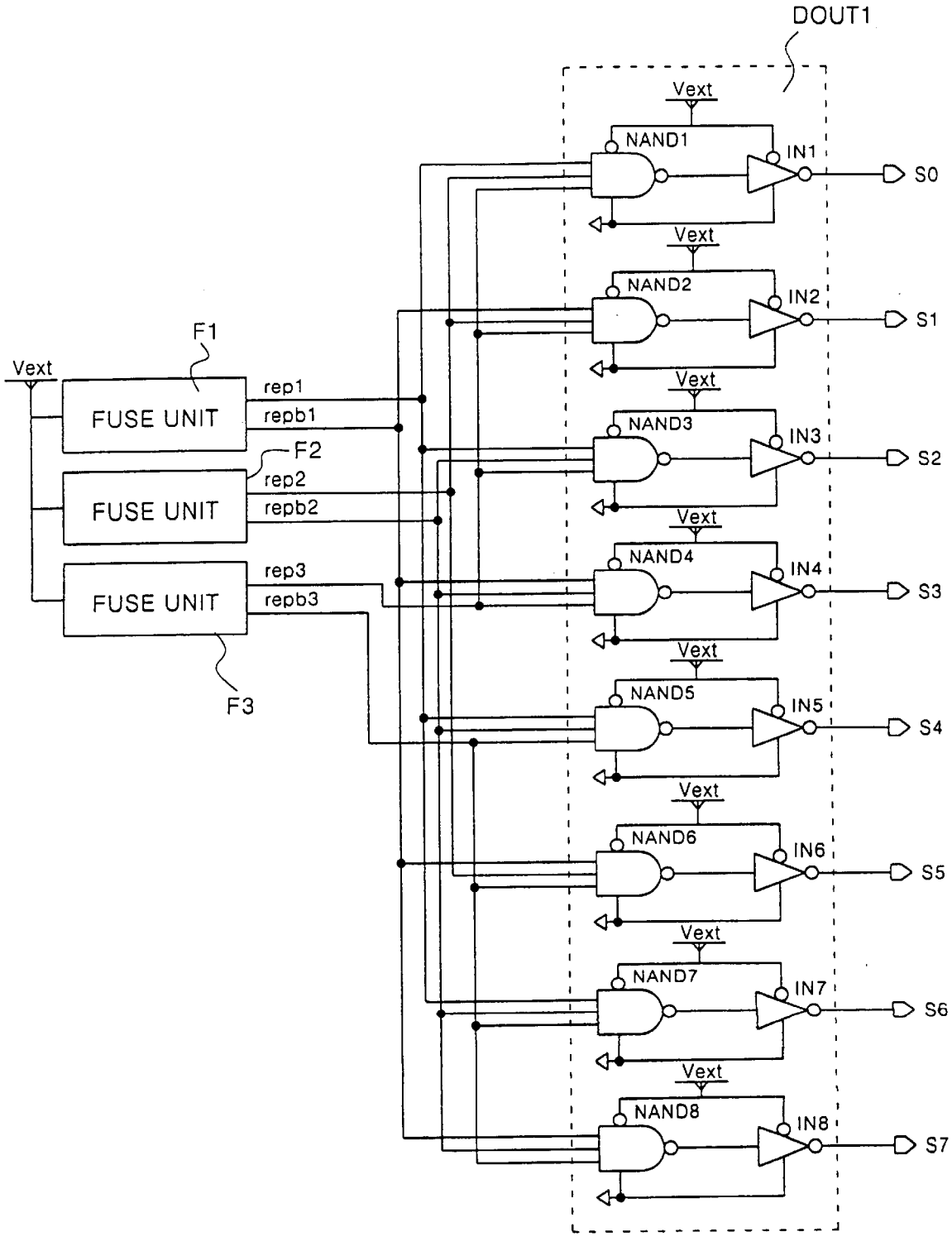
FIG.2 CONVENTIONAL ART
FIG. 2 is a detailed circuit diagram included in a decoding unit as shown in FIG. 1.
Figure 3:
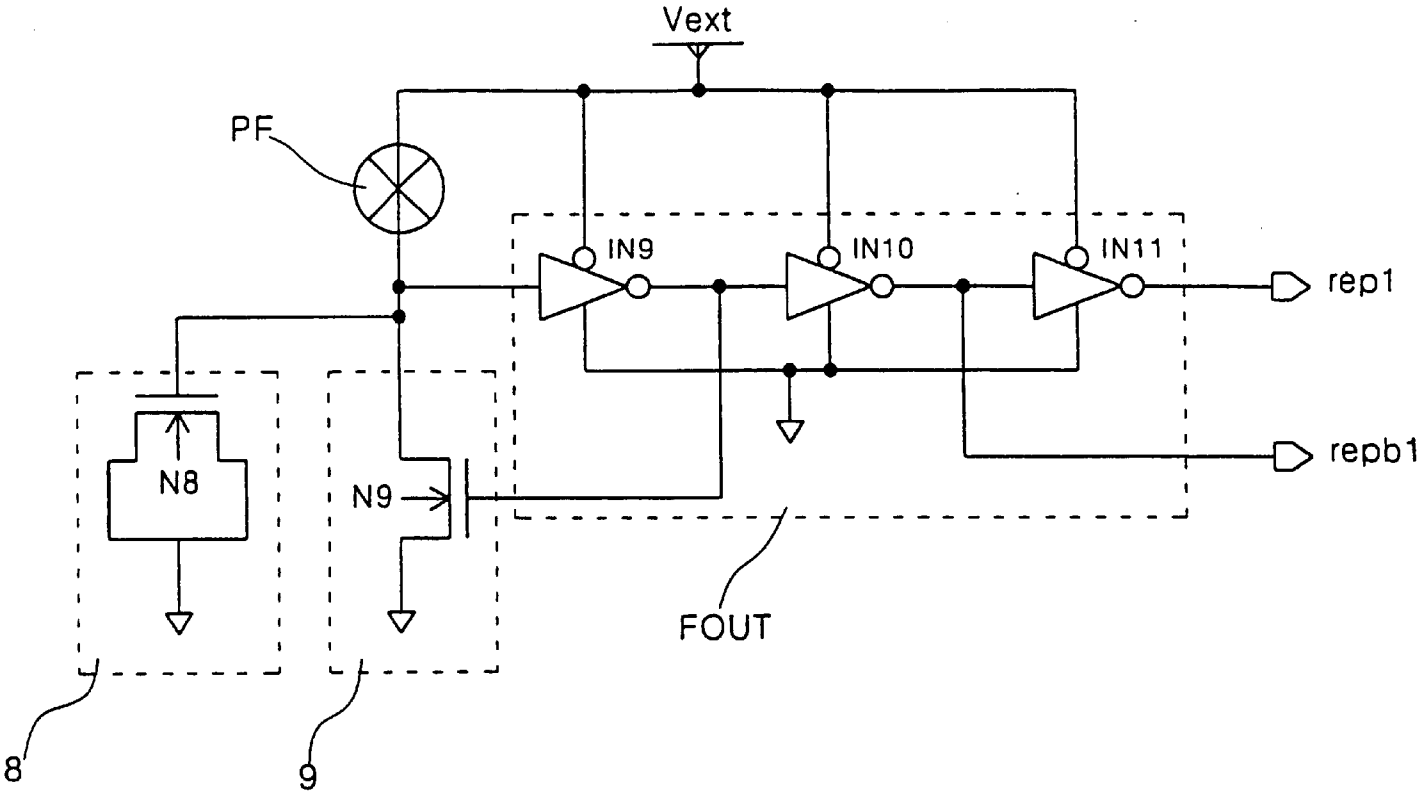
FIG.3 CONVENTIONAL ART
FIG. 3 is a detailed circuit diagram included in a fuse unit as shown in FIG. 2.

In the decoding means, an output unit DOUT2 is adapted to logically combine the signals REP1 and REPB1, REP2 and REPB2, and REP2 and REPB3 from said anti-fuse units 30, 40 and 50, thereby outputting the decoding, signals S0 to S7 to the second voltage generation unit 3 as,shown in FIG. 1.

The buffer 10 includes inverters 11 arid 12, 13 and 14, and 15 and 16 for sequentially inverting the voltage signal inputting through the bonding pads PAD1, PAD2, and PAD3, respectively.

The programming signal generation unit 20 includes a NOR gate 21 for inputting the signals from the buffer 10 to output the programming signal PGMB to the anti-fuse units 30, 40 and 50. The programming signal generation unit 20 further includes an inverter 22 far inverting the programming signal PGMB to apply an inverted programming signal PGM thereto.

Also, a pre-charge signal PRECHB generated from an internal circuit of the semiconductor device is applied to the anti-fuse units 30, 40 and 50, wherein the level of the pre-charged signal PRECHB makes a low to high transition after the anti-fuse is programmed.

The output unit DOUT2 is the same as the output unit DOUT1 of FIG. 1 in its construction.

Figure 5:
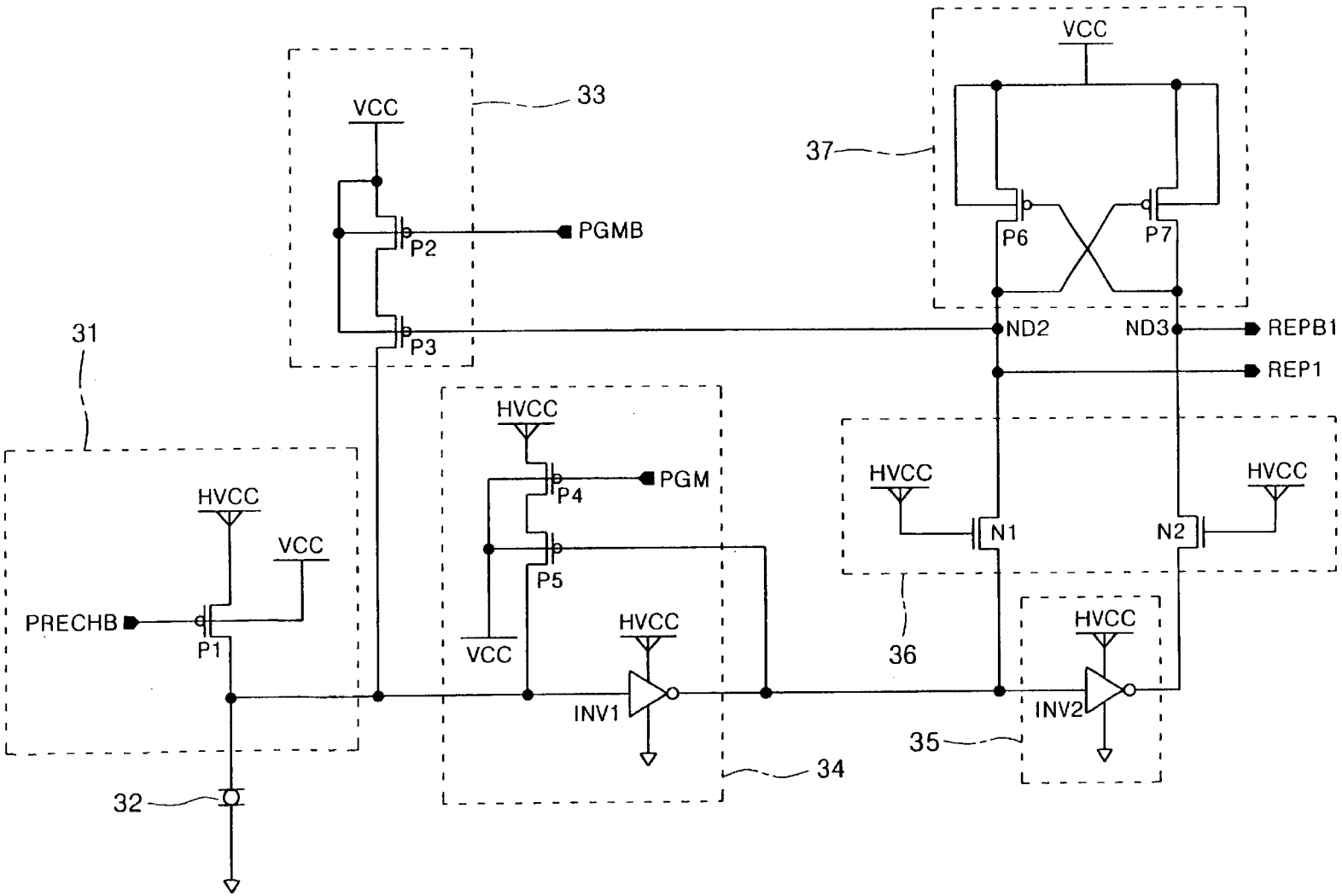
FIG. 5 is a detailed circuit diagram of an anti-fuse unit as shown in FIG. 4.

FIG. 5 is a detailed circuit diagram of the anti-fuse units 30, 40 and 50 as shown in FIG. 4.

With reference to this drawing, the anti-fuse unit 30 includes a pre-charge unit 31 driven by a pre-charge signal PRECHB to pre-charge a first node ND1 with a half of power supply voltage HVCC, and an anti-fuse 32 at its one side coupled to said pre-charge unit 31 and to said first node ND1 in common, and at its the other side grounded.

The anti-fuse unit 30 further includes a programming voltage supply unit 33 for applying a power supply voltage VCC to the anti-fuse 32 via the first node ND1 in response to a level of the programming signal PGMB and to the potential of a second node ND2, wherein the anti-fuse 32 can be programmed by the power supply voltage VCC.

The anti-fuse unit 30 further includes a latch unit 34 coupled to the first node ND1, and inputting a signal fed back from its output terminal, thereby causing the first node ND1 to be latched with the half of power supply voltage HVCC having a stable level, and an inverting unit 35 inverting the signal from the latch unit 34.

The anti-fuse unit 30 further includes a reverse current prevention unit 36 at its one side coupled to input and output terminals of the inverting unit 35, and at its the, other side coupled to the second node ND2 and a third node ND3, so that a reverse current cannot flow from the output signal lines REP1 and REPB1 respectively to the input and output terminals of said inverting unit 35, wherein the lines for output signals REP1 and REPB1 are connected to the second and third nodes ND2 and ND3, respectively.

The anti-fuse unit 30 further includes a feedback voltage supply unit 37 coupled to the reverse current prevention unit 36 via the second and third nodes ND2 and ND3, and applying a feedback voltage to the programming voltage supply unit 33, wherein the feedback voltage has the level of the power supply voltage VCC.

The pre-charge unit 31 is provided with a P-channel MOS transistor P1 driven by the pre-charge signal PRECHB, and supplying the first node ND1 with the half of the power supply voltage HVCC.

The programming voltage supply unit 33 includes a P-channel MOS transistor P2 driven by the programming signal PGMB, and supplied with the power supply voltage VCC, and a P-channel MOS transistor P3 serially connected to the P-channel MOS transistor P2, and driven by the potential of the second node ND2.

The latch unit 34 includes a P-channel MOS transistor P4 driven by the inverted programming signal PGM from the programming signal generation unit 20, and supplied with the half of the power supply voltage HVCC, a P-channel MOS transistor P5 serially connected to the P-channel MOS transistor P4 and to the first node ND1, and driven by a feedback voltage, and an inverter INV1 for inverting the voltage signal at the first node ND1, and applying the inverted signal to the inverting unit 35.

The inverting unit 35 is provided with ah inverter INV2 for being supplied with the half of the power supply voltage HVCC, and inverting an output signal of the latch unit 34 prior to applying the inverted signal to the reverse current prevention unit 36.

The reverse current prevention unit 36 further includes a N-channel MOS transistor N1 connected between the second node ND2 and an input terminal of the inverting unit 35, and driven by the half of the power supply voltage HVCC, and a N-channel MOS transistor N2 connected between the third node ND3 and an output terminal thereof.

The feedback voltage supplying unit 37 includes a pair of P-channel MOS transistors P6 and P7 forming a cross-coupled feedback loop, thereby supplying the third and second nodes ND3 and ND2 with the power supply voltage VCC, respectively.

On the other hand, the anti-fuse units 40 and 50 of FIG. 4 are the same as the above mentioned anti-fuse unit 30 in their constructions.

Hereinafter, the operation of the internal voltage generator using anti-fuse will be described in detail referring to the attached drawings.

As shown in FIG. 4, the buffer 10 changes the signals of TTL level which are externally inputted through the bonding pads PAD1, PAD2 and PAD3 to those of CMOS level. Namely, if it is required to trim the internal voltage at the packaging process of the semiconductor device, the voltage signals of the TTL level as shown in FIG. 6 are inputted to the bonding pads PAD1 to PAD3. The inverters 11 and 12 in the buffer 10 sequentially invert the signal inputted via the bonding pad PAD1 to apply inverted signal to the programming signal generation unit 20. In this manner, the inverters 13 to 16 are operated.

The NOR gate 21 in the programming signal generation unit 20 outputs the programming signal PGMB of the low level to the anti-fuse units 30, 40 and 50, in the case that at least one of the signals from the buffer 10 has the high level, that is, at least one of the signals inputted through the bonding pads PAD1 to PAD3 has the high level. The inverter 22 inverts the programming signal PGMB from the NOR gate 21 to output the inverted programming signal PGM thereto.

Thereafter, as shown in FIG. 5, the anti-fuse 32 in the anti-fuse unit 30 is programmed according to the level of the programming signal PGMB as described below.

Firstly, when the anti-fuse 32 is in the normal state, the pre-charge signal PRECHB-of the low level is applied to the gate of the p-channel MOS transistor P1 in the pre-charge unit 31, and the inverted programming signal PGM of the low level is inputted to the gate of the p-channel MOS transistor P4 in the latch unit 34. At this time, the programming signal PGMB of the high level is inputted to the gate of p-channel MOS transistor P2 in the programming voltage supply unit 33.

Therefore, the p-channel MOS transistor P1 is turned ON to pre-charge the first node ND1 with the half of the power supply voltage HVCC. The inverter INV1 in the latch unit 34 generates a signal having the low level which is fed back to the gate of the p-channel MOS transistor 25 therein. Accordingly, the p-channel MOS transistors 24 and P5, are turned on such that the half of the power supply voltage HVCC is applied to the first node ND1.

Thus, the first node ND1 is pre-charged with the half of the power supply voltage HVCC, and thereafter the pre-charge signal PRECHB makes low to high transition to turn Off the p-channel MOS transistors P1.

At this time, the n-channel MOS transistors N1 and N2 are always in a turned-on state by the half of the power supply voltage HVCC. Thus, the signal of the low-level from the latch unit 34 is inverted by the inverter INV2 in the inverting unit 35, so that the signal of the high level is applied to the third node ND3 via the n-channel MOS transistors N2 in the reverse current prevention unit 36, wherein the high level corresponds to the half of the power supply voltage HVCC. Since the second node ND2 is connected to the output terminal of the latch unit 34 via the n-channel MOS transistors N1 therein, a signal of the low level appears at the second node ND2, and thus the inverted output signal REP1 becomes to have the low level. At this time, the p-channel MOS transistor P2 in the programming voltage supply unit 33 is turned ON. Further, the p-channel MOS transistor P7 in the feedback voltage supplying unit 37 is turned on in response to the low level at the second node ND2, so that the power supply voltage VCC is applied to the third node ND3.

As a result, in the case that the anti-fuse 32 is in the normal state, that is, the programming signal PGMB has the high level, the output signal REPB1 having the high level and the inverted output signal REP1 are outputted, wherein the output signal REPB1 has the high level of the power supply voltage VCC.

In the case that the voltage at the third node ND3 has the level of the power supply voltage VCC, a reverse current may flow toward the output terminal of the inverter INV2 in the inverting unit 35 because the high voltage of the output terminal thereof has the level of the half of the power supply voltage HVCC.

To prevent the reverse current, the present invention provides the reverse current prevention unit 36.

Namely, since the n-channel MOS transistors N1 and N2 in the reverse current prevention unit 36 are driven by the half of the power supply voltage HVCC, an amount of the current capable of flowing through the transistors N1 and N2 is determined by the voltage difference between the half of the power supply voltage HVCC and the threshold voltages of the transistors N1 or N2, and thus the reverse current is to be prevented.

In this manner, the n-channel MOS transistor N1 functions for preventing the reverse current flowing from the second node ND2 toward the input terminal of the inverter INV2.

Meanwhile, in the case that the anti-fuse 32 is programmed, the p-channel MOS transistor P2 is turned on because the programming signal PGMB has the low level as shown in FIG. 6. At this time, the inverted signal PGM becomes to have the high level to turn off the p-channel MOS transistor P4. In this case, the potential of the second node ND2 is in the state of the low level as described hereinbefore.

Thus, the power supply, voltage VCC is applied to the anti-fuse 32 via the first node ND1 to short a dielectric layer formed between two electrodes. Accordingly, a current path is formed through the anti-fuse 32 toward a ground, so that the potential at the first-node ND1 goes the low level. Therefore, a signal of the low level appears at the first node ND1 to sequentially inverted by the inverters INV1 and INV2 included in the latch unit 34 and inverting unit 35, respectively. As a result, a signal of the low level appears at the third node ND3 such that the output signal REPB1 becomes to have the low level.

At this time, the signal of the high level which corresponds to the half of the power supply voltage HVCC is applied to the second node ND2, so that the inverted output signal REP1 of the high level is outputted and the p-channel MOS transistor P3 in the programming voltage supply unit 33 is turned Off. Thus, the current path formed through the anti-fuse 32 toward a ground is blocked. Also, when the signal of the low level appears at the third node ND3, the p-channel MOS transistor 26 in the feedback voltage supply unit 37 is turned thereby causing-the power supply voltage VCC to be applied to the second node ND2.

Since the half of the power supply voltage HVCC is fed back to the gate, of the p-channel MOS transistor P3 and the power supply voltage VCC is also applied thereto, the current path is capable of being blocked rapidly, thereby reducing the current consumption.

The anti-fuse units 40 and 50 are operated in the same manner as the anti-fuse unit 30. Thus, the description as to the operation thereof will be omitted.

As described hereinbefore, the output signals REPB1 to REPB3 and the inverted output signals REP1 to REP3 as shown in FIG. 6 are logically combined in the output unit DOUT2, with the anti-fuse 32 being programmed by the programming signal PGMB. As the result, the one of the decoding signals S0 to S7 of FIG. 6 is active Thereafter, the decoding signals S0 to S7 are applied to the second voltage generation unit 3 of FIG. 1 so that it generates the internal voltage Vr2 on the basis of the decoding signals S0~S7, wherein the internal voltage Vr2 has a different level according to the decoding signals S0~S7.

As apparent from the above description, the present invention applies the voltage signals for trimming the internal voltage to the decoding means via the bonding pads, and then programs the anti-fuses included in the decoding means to generate the decoding signals. Using the decoding signals, the present invention can generate internal voltages, each of which has a different level. Thus, the present invention makes it possible to apply the voltage signals from the outside to the bonding pads of the semiconductor device, and thus to conveniently trims the internal voltage even at a packaging step process of the semiconductor device.

Further, since the present invention can rapidly block the current path using the cross-coupled feedback loop, wherein the current path is formed through the anti-fuse after the anti-fuse is programmed, it can reduce a current amount consumed when the anti-fuse is programmed.

What is claimed is:

1. An internal voltage generator comprising:

a voltage generator and a decoding means, said internal voltage generator trims an inputted voltage on the basis of decoding signals from said decoding means therein to generate internal voltages having a level different from each other, wherein said decoding means, comprises:

a buffer means comprising even numbers of inverters serially coupled to bonding pads, said buffer means changing voltage signals of TTL level inputted through said bonding pads to those of CMOS level;

a programming signal generation means generating signals for programming an anti-fuse in accordance with signals from said buffer mans;

a plurality of anti-fuse units, each anti-fuse unit having said anti-fuse capable of being programmed by the signals from said programming signal generation means, and outputting signals in response to a state of said anti-fuse; and an output means logically combining the signals from said anti-fuse units, thereby outputting said decoding signals.

2. An internal voltage generator as set forth in claim 1, wherein said programming signal generation means further comprises:

a NOR gate inputting the output signals of said-buffer means, thereby outputting a programming signal to each of said anti-fuse units; and an inverter inverting said programming signal, thereby outputting an inverted programming signal thereto.

3. An internal voltage generator as set forth in claim 1, wherein said anti-fuse unit is supplied with said pre-charge signal for pre-charging a predetermined internal node with a half of a power supply voltage.

4. An internal voltage generator as set forth in claim 1, wherein each said anti-fuse unit further comprises:

pre-charge means driven by a pre-charge signal, and pre-charging a first node with a half of a power supply voltage;

said anti-fuse at its one side coupled to said pre-charge means and to said first node in common, and at its the other side grounded;

programming voltage supply means applying the power supply voltage to said anti-fuse via said first node in response to a level of a programming signal and to the potential of a second node, wherein said anti-fuse can be programmed by the power supply voltage;

latch means coupled to said first node, and inputting a signal fed back-from its output terminal, thereby causing said first node to be latched with the half of power supply voltage having a stable level;

inverting means inverting the signal from said latch means;

reverse current prevention means at its one side coupled to input and output terminals of said inverting means, and at its the other side coupled to said second node arid a third node, so that a reverse current can not flow from said second and third nodes to the input and output terminals of said inverting means, wherein lines for output signals are connected to the second and third nodes, respectively; and feedback voltage supply means coupled to said reverse current prevention means via said second and third nodes, and applying a feedback voltage to said programming voltage supply means, wherein said feedback voltage has the level of the power, supply voltage.

5. An internal voltage generator as set forth in claim 4, wherein said pre-charge means is provided with a P-channel MOS transistor driven by said pre-charge signal, and supplying said first node with the half of the power supply voltage.

6. An internal voltage generator as set forth in claim 4, wherein said programming voltage supply means further comprises:

a first P-channel MOS transistor driven by said programming signal, and supplied with the power supply voltage; and a second P-channel MOS transistor serially connected to said first P-channel MOS transistor, and driven by the potential of said second node.

7. An internal voltage generator as set forth in claim 4, wherein said latch means further comprises:

a first P-channel MOS transistor driven by an inverted programming signal from said programming signal generation means, and supplied with the half of the power supply voltage;

a second P-channel MOS transistor serially connected to said first P-channel MOS transistor and to said first node, and driven by a feedback voltage from the output terminal of said latch means; and an inverter inverting voltage signal at said first node, and applying the inverted signal to said inverting means.

8. An internal voltage generator as set forth in claim 4, wherein said inverting means is provided with an inverter supplied with the half of the power supply voltage, and inverting an output signal of said latch means prior to applying the inverted signal to said reverse current prevention means.

9. An internal voltage generator as set forth in claim 4, wherein said reverse current prevention means further comprises:

a N-channel MOS transistor connected between said second node and an input terminal of said inverting means, and driven by the half of the power supply voltage; and a N-channel MOS transistor connected between said third node and an output terminal thereof.

10. An internal voltage generator as set forth in claim 4, wherein said feedback voltage supplying means is provided with a pair of P-channel MOS transistors forming a cross-coupled feedback loop, thereby supplying said third and second nodes with the power supply voltage.

11. An internal voltage generator as set forth in claim 4, wherein said pre-charge signal makes a low to high transition after said anti-fuse is programmed.

12. A decoding circuit that provides decoding signals to an internal voltage generator, said internal voltage generator trimming an inputted voltage on the basis of said decoding signals, said decoding circuit comprising:

a buffer means comprising even numbers of inverters serially coupled to bonding pads, said buffer means changing voltage signals of TTL level inputted through bonding pads to those of CMOS level;

a programming signal generation means generating signals for programming an anti-fuse in accordance with signals from said buffer means;

a plurality of anti-fuse units, each anti-fuse unit having an anti-fuse capable of being programmed by the signals from said programming signal generation means, and outputting signals in response to a state of anti-fuse; and an output means logically combining the signals from said anti-fuse units, thereby outputting said decoding signals.

13. A decoding circuit as set forth in claim 12, wherein said programming signal generation means further comprises:

a NOR gate inputting the output signals of said buffer means, thereby outputting a programming signal to each of said anti-fuse units; and an inverter inverting said programming signal, thereby outputting an inverted programing signal thereto.

14. A decoding circuit as set forth in claim 12, wherein said anti-fuse unit is supplied with said pre-charge signal for pre-charging a predetermined internal node with a half of power supply voltage.

15. A decoding circuit as set forth in claim 12, wherein each said anti-fuse unit further comprises:

pre-charge means driven by a pre-charge signal, and pre-charging a first node with a half of a power supply voltage;

said anti-fuse at its one side coupled to said pre-charge means and to said first node in common, and at its the other side grounded;

programming voltage supply means applying the power supply voltage to said anti-fuse via said first node in response to a level of a programming signal and to the potential of a second node, wherein said anti-fuse can be programmed by the power supply voltage;

latch means coupled to said first node, and inputting a signal fed back from its output terminal, thereby causing said first node to be latched with the half of power supply voltage having a stable level;

inverting means inverting the signal from said latch means;

reverse current prevention means at its one side coupled to input and output terminals of said inverting means, and at its the other side coupled to said second node and a third node, so that a reverse current can not flow from said second and third nodes to the input and output terminals of said inverting means, wherein lines for output signals are connected to the second and third nodes, respectively; and feedback voltage supply means coupled to said reverse current prevention means via said second and third nodes, and applying a feedback voltage to said programming voltage supply means, wherein said feedback voltage has the level of the power supply voltage.

16. A decoding circuit as set forth in claim 15, wherein said pre-charge means is provided with a P-channel MOS transistor driven by said pre-charge signal, and supplying said first node with the half of the power supply voltage.

17. A decoding circuit as set forth in claim 15, wherein said programming voltage supply means further comprises:

a first P-channel MOS transistor driven by said programming signal, and supplied with the power supply voltage; and a second P-channel MOS transistor serially connected to said first P-channel MOS transistor, and driven by the potential of said second node.

18. A decoding circuit as set forth in claim 15, wherein said latch means further comprises:

a first P-channel MOS transistor driven by an inverted programming signal from said programming signal generation means, and supplied with the half of the power supply voltage;

a second P-channel MOS transistor serially connected to said first P-channel MOS transistor and to said first node, and driven by a feedback voltage from the output terminal of said latch means; and an inverter inverting voltage signal at said first node, and applying the inverted signal to said inverting means.

19. A decoding circuit as set forth in claim 15, wherein said inverting means is provided with an inverter supplied with the half of the power supply voltage, and inverting an output signal of said latch means prior to applying the inverted signal to said reverse current prevention means.

20. A decoding circuit as set forth in claim 15, wherein said reverse current prevention means further comprises:

a N-channel MOS transistor connected between said second node and an input terminal of said inverting means, and driven by the half of the power supply voltage; and a N-channel MOS transistor connected between said third node and an output terminal thereof.

21. A decoding circuit as set forth in claim 15, wherein said feedback voltage supplying means is provided with a pair of P-channel MOS transistors forming a cross-coupled feedback loop, thereby supplying said third and second nodes with the power supply voltage.

22. A decoding circuit as set forth in claim 15, wherein said pre-charge signal makes a low to high transition after said anti-fuse is programmed.

* * * * *